US005786003A

United States Patent [19]

Debbia

[11] Patent Number: 5,786,003

[45] Date of Patent: Jul. 28, 1998

[54] HALF-DIE FOR CERAMIC TILES

[75] Inventor: Ivano Debbia, Formigine, Italy

[73] Assignee: F.D.S. S.r.L., Sassuolo, Italy

[21] Appl. No.: 721,531

[22] Filed: Sep. 26, 1996

[30] Foreign Application Priority Data

Dec. 13, 1995 [IT] Italy ..... M095A0170

[51] Int. Cl.[6] ..... B28B 3/04

[52] U.S. Cl. ..... 425/405.1; 425/406; 425/DIG. 44

[58] Field of Search ..... 425/405.1, 405.2, 425/406, DIG. 44

[56] References Cited

U.S. PATENT DOCUMENTS 4,349,326 9/1982 Foster et al. ..... 425/405.1

5,120,213 6/1992 Bühler et al. ..... 425/405.1

5,330,346 7/1994 Scardovi ..... 425/405.1

*Primary Examiner*—James P. Mackey

*Attorney, Agent, or Firm*—Browdy and Neimark

[57] ABSTRACT

The improved half-die comprises a concave rigid support describing a chamber superiorly closed by an elastic wall and containing a pressurised incompressible fluid. The chamber internally comprises a lattice which divides it into a plurality of cavities which are interconnected by means of communication holes; each cavity is occupied by an obturator which is solidly anchored to the elastic wall and free of the walls of the relative cavity. Should there be a loss of fluid pressure, which can occur only through an inlet hole and an outlet hole used for introducing the fluid during a construction phase of the half-die and subsequently closed, the obturators prevent any further fluid from exiting during a pressing operation and enable the half-die to keep working.

6 Claims, 2 Drawing Sheets

HALF-DIE FOR CERAMIC TILES

BACKGROUND OF THE INVENTION

Reference is made in particular to special types of half-dies making up part of a type of die known as isostatic, made according to the principles described in Italian patent no. 1,240,242, used in the production of uniformly compressed tiles and provided with coplanar reliefs on the bottom surface thereof. The material to be compacted (ceramic powder) to make the tile is pressed between two half-dies, one of which is a "special" half-die of a kind with the tile now described, and exhibits an elastic rubber wall closing a chamber which is filled with an incompressible fluid. The bottom surface of the tile is negatively imprinted on the external surface of the elastic wall. The points on the internal surface of the wall which correspond to the negative imprint are fixed to a lattice predisposed internally of the chamber, while at the other points the wall is free to deform following the action of the fluid.

Dies such as the above-described obtain a pressed product which inferiorly exhibits a relief defining a flat product rest surface, and which at the same time exhibits a same density in all parts thereof, even in cases where the powders were not originally distributed evenly in the die, or where the powders themselves are not homogeneous. Subsequently to the market appearance of the dies made according to above-mentioned Italian patent no. 1,240,242, a considerable quantity of constructional modifications and improvements have been made, several of which have been made object of patent applications, all of which have the declared aim of facilitating the construction and use of these isostatic dies. Not always, however, have the set aims been satisfactoriy attained.

One of the main problems exhibited by known isostatic dies has been that the special half-die, thus in effect the whole die, cannot function when there has been a loss of the fluid contained therein.

SUMMARY OF THE INVENTION

The aim of the present invention is to eliminate the above-mentioned drawbacks by providing a half-die which is easy and fast to construct and which functions even in the absence of fluid internally thereof.

An advantage of the half-die of the invention is that it can be made using various known production technologies.

A further advantage of the half-die is that should any loss of fluid occur, it is limited and the die can still perform, at least partially, as an isostatic die.

A still further advantage of the half-die of the invention is that it contains a limited quantity of fluid.

These aims and more besides are all attained by the die of the invention, as it is characterised in the appended claims.

BRIEF DESCRIPTION OF THE DRAWINGS

Further characteristics and advantages of the present invention will better emerge from the detailed description that follows, of an embodiment of the invention, illustrated in the form of a non-limiting example in the accompanying drawings, in which.

Figure 2:
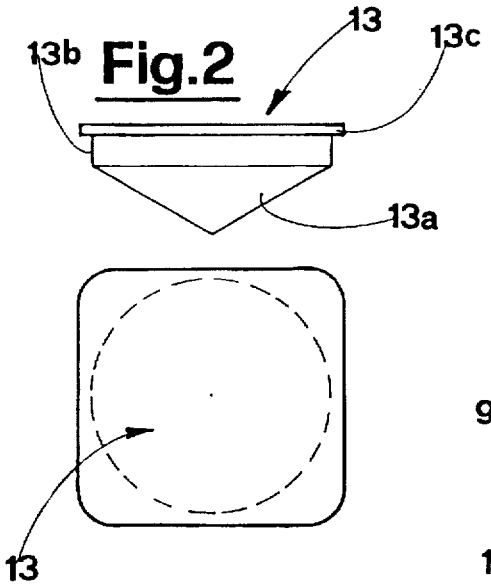
FIG. 2 is an enlarged-scale illustration of a lateral view and a view from above of an obturator of the half-die of the invention.
Figure 3:
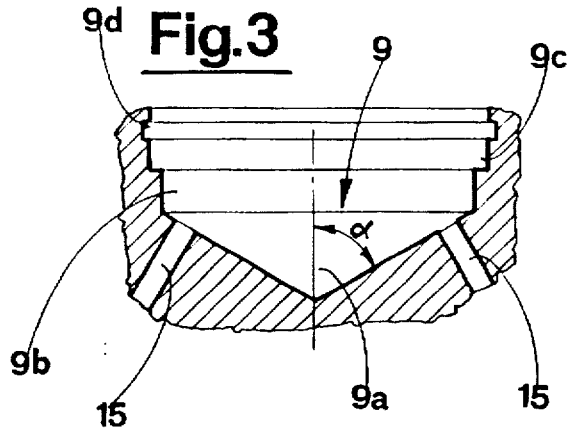
FIG. 3 is an enlarged-scale view of a detail of following FIG. 4, relating to a cavity in the half-die.
Figure 1:
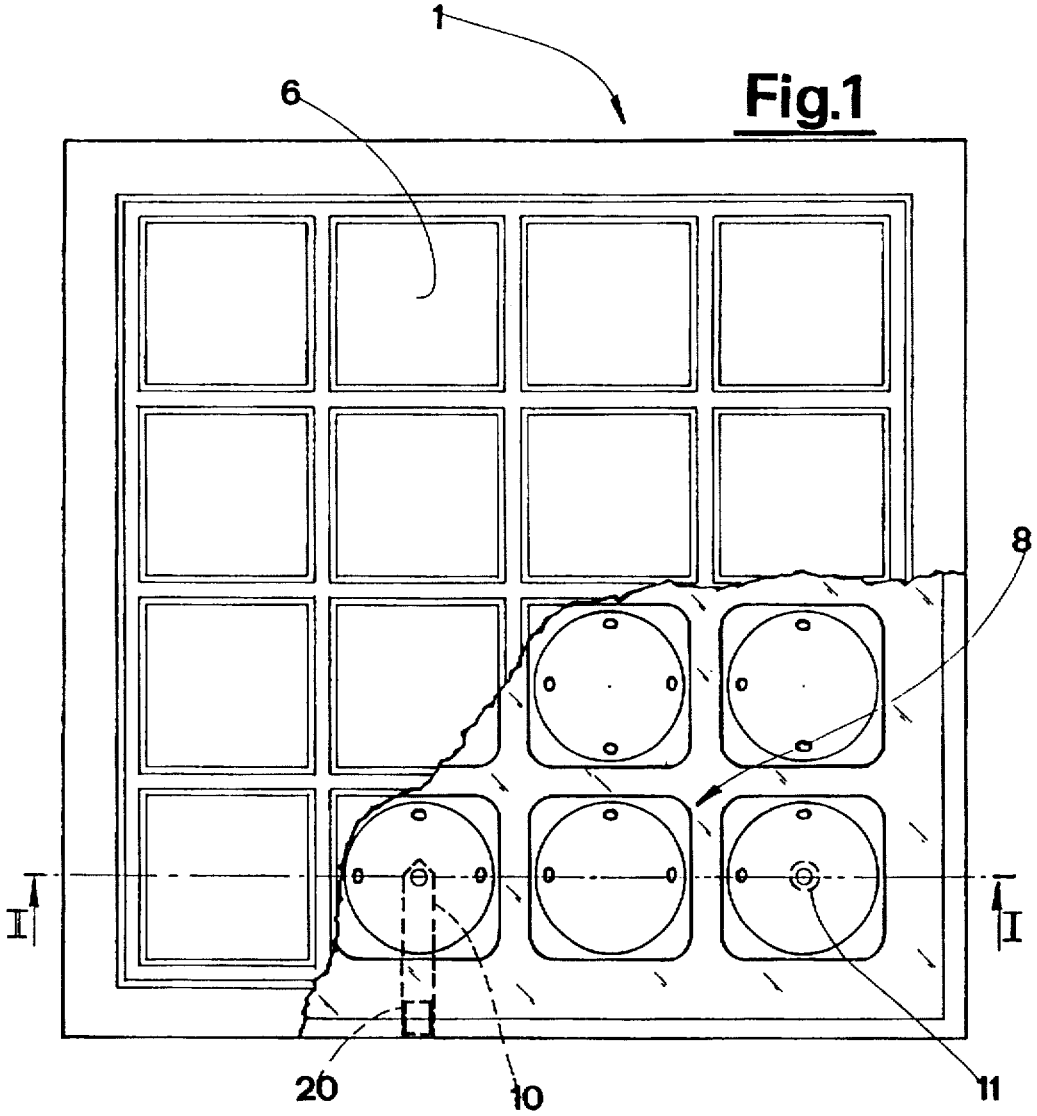
FIG. 1 is a plan view from above of the half-die of the invention, with some parts removed better to evidence others.

DESCRIPTION OF THE PREFERRED EMBODIMENTS.

With reference to the above-mentioned figures, 1 denotes a half-die for realising, in combination with a second half-die 2 of known type, ceramic tiles 30 provided on one face thereof with coplanar reliefs 31. The half-die 1 comprises a rigid concave metal support 4, exhibiting a chamber 5 which is open at its upward-facing side, internally of which is situated a lattice 8 dividing the chamber 5 into a plurality of cavities 9.

As in half-dies of known type, the half-die of the invention comprises an elastic wall 6 which superiorly closes the chamber 5 and is solidly anchored to the edge **5*a* of the chamber 5 and the upper surface 8*a* of the lattice 8. This edge 5*a* and upper surface 8*a*** provide a rigid rest plane for the reliefs of thé tiles to be produced.

Each of the cavities 9 exhibits a bottom **9*a* having inclined converging walls 12 which bottom is conical in shape having an aperture angle alpha of about 60 degrees. This angle represents the aperture angle of normal drill bits, considerably facilitating the construction thereof. Each cavity further exhibits a cylindrical intermediate zone 9*b* with a diameter equal to the diameter of the base of the conical zone and coaxial thereto, and an upper zone 9*c* having a section which circumscribes the section of the intermediate zone 9*b***.

An obturator 13 is provided for each of the cavities 9, which obturator 13 is made of semi rigid plastic material and is conformed in such a way as to occupy substantially all of the zone of the relative cavity 9 behind the elastic wall 6. In the shown embodiment, the obturators 13 have a conical zone **13*a*, a cylindrical zone 13*b* and an upper zone 13*c* entirely equal to the corresponding zones of the cavities 9**; their total breadth is about 8–10 mm.

The half-die is assembled in such a way that the obturators 13 are solidly anchored to the elastic wall 6, but are free of the lateral walls of the relative cavities 9.

The cavities 9 are all interconnected through communication holes 15 which open into the inclined walls 12 of the cavities 9; in particular, in order to facilitate their construction, the holes 15 exhibit an axis which is perpendicular to the relative inclined walls. The half-die is further provided with an inlet hole 10 and an outlet hole 11, made in the metal support 4, each of which holes 10 and 11 is provided with a mouth which is external to the half-die, and an internal hole opening into the chamber 5. in particular, each of the internal holes opens on to the bottom point of one of the cavities 9.

The metal support 4 is made in a single piece and all the described characteristics are made by simple work operations. The chamber 5 exhbits only three connections with the outside, which are namely the upper aperture, the inlet hole 10 and the outlet hole 11; the inlet hole 10 and the outlet hole 11 are made in such a way that their external holes are at a distance from the elastic wall which is greater than the distance from said elastic wall of any point of the chamber 5 or the communication holes 15.

Figure 5:
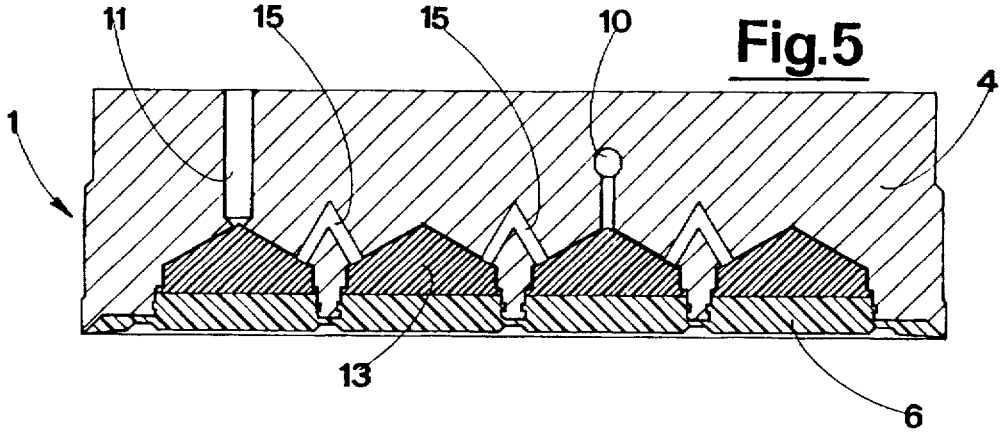
FIG. 5 is a section of the half-die, made according to line I—I of FIG. 1, illustrated before filling the half-die with pressurised fluid.
Figure 4:
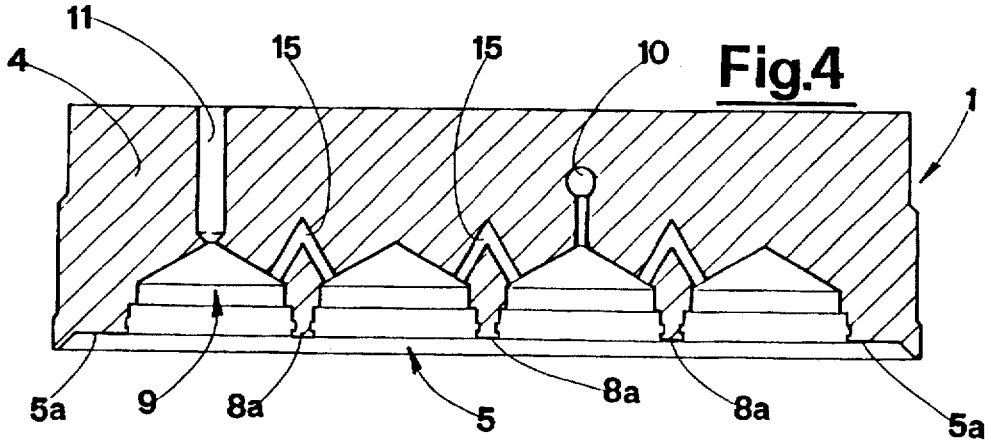
FIG. 4 is a section of the rigid support of the half-die, made according to line I—I of FIG. 1.

Once the rigid support has been made, as illustrated in FIG. 4, the pre-fabricated obturators 13 are positioned in the cavities 9. It may be worthwhile, though not indispensable, to spread a detaching agent on the walls of the cavities 9. Then the elastic wall 6 is realised by means of the usual methods, for example by casting and polymerization of resins, or vulcanization of rubber at high pressures and temperatures. Note that the use of the latter process, which is preferable when possible because it gives better results, leads to no problems inasmuch as the presence of the obturators enables high pressures to be used without causing undesired deformations. Once this phase is over, the half-die is as illustrated in FIG. 5, wherein the elastic wall 6 is solidly connected to the edge 5*a*, the upper surface 8*a* of the lattice and the upper surface (13*c* area) of the obturators. To improve this connection, the above-indicated surfaces can, before realisation of the wall 6, be spread with appropriate glues of known type. To enhance anchoring of the elastic wall 6 to the metal support 4, it is advantageous to make, internally of the cavities 9, underlying peripheral channels 9*d* into which the material constituting the elastic wall 6 inserts during the forming phase. Once the elastic wall 6 has been made, an incompressible fluid is introduced into the half-die through the inlet hole 10. The fluid filters among the inevitable play existing between the bottom wall of the cavities 9 and the obturators 13 (which are detached from the cavities 9 and can thus slide with respect thereto, favoured by the elasticity of the wall 6), occupying all the available spaces internally of the half-die itself. During this phase, the air contained in the half-die exits from the outlet hole 11. When all of the air has exited, the outlet hole 11 is hermetically closed via a second cap 21; more fluid is introduced, by some conventional means for pressurizing, up until when the fluid contained in the half-die reaches a pressure which is superior to atmospheric pressure. When the desired pressure, usually a few bars , has been reached, the inlet hole 10 is also hermetically closed, for example by a first cap 20; it is possible, should it be so desired, to connect the half-die with other half-dies of the same type, by affording in the inlet hole 10 a single-acting valve which allows fluid to be introduced and stays in the inlet hole 10 after the half-die is full, closing same.

Figure 6:
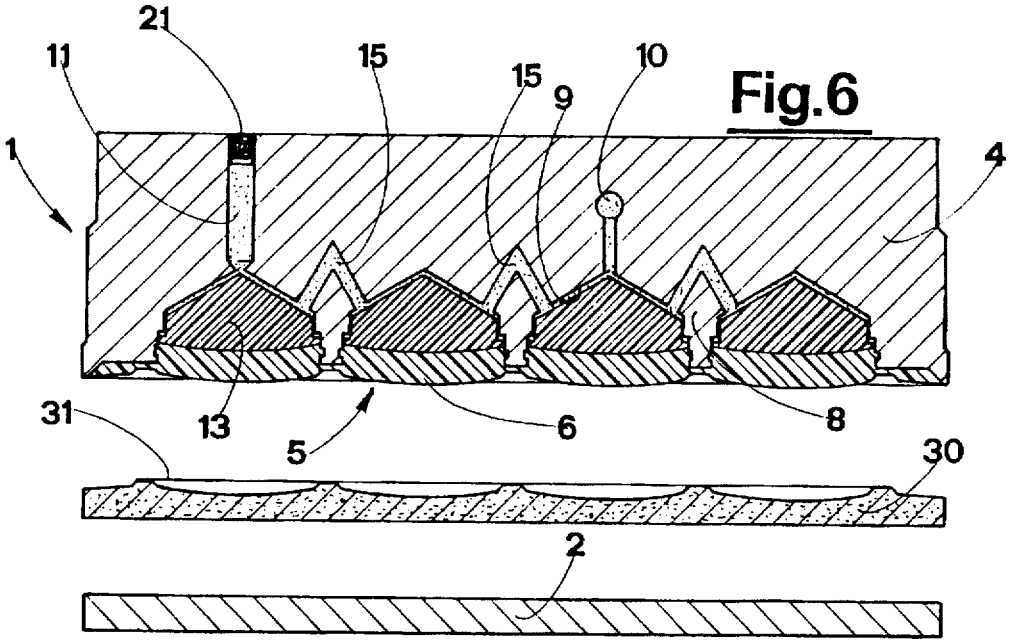
FIG. 6 is a section of the half-die made according to line I—I of FIG. 1, combined with a section of a tile made and a schematic section of the second half-die which couples to the half-die of the invention to constitute the die for realising the tile.

The fluid pressure causes the obturators 13 to rise slightly and the elastic wall 6 to bulge somewhat from the cavities 9; this situation, in which the semi-die is ready for use, is illustrated in FIG. 6.

The half-die of the invention functions, under normal conditions, like known-type half-dies of the type described in Italian patent no. 1,240,242, but has the advantage thereover, while allowing both negative and positive compensation, of containing a limited quantity of fluid and thus avoiding possible brusque snap-backs of the elastic wall, which seldom but sometimes can lead to cracks in the tiles.

If there should be a considerable dishomogeneity or load difference in the material to be compacted, and some of the obturators were to press against the bottom wall of the relative cavities, the half-die of the invention is decidedly advantageous with respect to known-type half-dies of various types, wherein, in circumstances such as these, there may be not only insufficient compensation but also a blocking of the holes and a deterioration of the elastic wall and possibly in other bodies ("hollow caps") present in some half-dies between the elastic wall and the bottom of the cavities. Indeed, in the die of the invention, the increased thickness of the plastic, elastic (the wall) and semirigid material (the obturator) allows for, in this situation, a further deformation with a consequent further compensation which, in this case, is not completely isostatic. There is also no deterioration either in the state of the obturators or in that of the elastic wall (which, given the great thickness of the obturators, is important inasmuch as the pressure exerted on the obturators is distributed over the conical contact wall between obturator and cavity).

Should there be any loss of fluid, known-type half-dies empty completely and deteriorate immediately, becoming useless. This creates considerable problems, for example during night shifts in tile formation lines.

The half-die of the invention, on the other hand, even when fluid loss occurs, which thanks to its very conformation can only occur through the inlet and outlet holes, or through fissures in the elastic wall, can continue to work in the same way as a rigid half-die, compensating all the same even though only partially and not isostatically. This is due to the considerable thickness of the plastic elastic material (which deforms elastically more or less according to the load conditions).

Under many conditions the half-die, thank to its conformation, can continue to work, compensating isostatically in part. Indeed, in the case of a loss through the inlet or outlet holes, during the pressing phase the obturators immediately close the hole through which fluid is being lost and present outflow thereof from inside the half-die. In a case of loss through the elastic wall, during the pressing phase, the obturator, in the zone where the loss is occurring, immediately closes the connection holes of the relative cavity, completely isolating it from the rest of the chamber and preventing outflow of the fluid in the other cavities in the half-die.

To sum up, whereas in half-dies of known type a fluid loss during the pressing phase leads to an immediate emptying of the half-die, in the half-die of the invention an outflow of fluid can occur only when the half-die is not in the pressing phase; a depressurisation of the fluid in the half-die is thus much slower, and the half-die can continue, even in cases of fluid loss, to function isostatically for a length of time corresponding to the size of the hole (generally small, usually leading to a seeping rather than a gush) causing said fluid loss.

In any case, even where the fluid has been completely depressurised, the play existing between the bottom of the cavities and the obturators as well as the connection holes remain full of fluid inasmuch as the geometrical conformation of the half-die prevents emptying thereof. Thus, in these conditions too the half-die can function isostatically.

What is claimed:

1. An isostatic half-die for ceramic tiles, used in production of uniformly compressed tiles having coplanar reliefs, comprising:

a concave rigid support describing a chamber which chamber is superiorly open;

a lattice located internally of said chamber, which divides the chamber into a plurality of intercommunicating cavities, connected one to another by means of communication holes;

an elastic wall superiorly closing said chamber and being solidly anchored to an edge of said chamber and an upper surface of said lattice, which elastic wall and which upper surface form a rigid rest plane for said reliefs of said tiles;

an incompressible fluid which occupies available fluid space internally of said half-die in said cavities and said communication holes;

an inlet hole and an outlet hole for said incompressible fluid, provided with an inlet hole internal mouth and an outlet hole internal mouth situated internally of said chamber, and provided with an inlet hole external mouth and an outlet hole external mouth situated externally of said half-die; wherein:

each of the cavities exhibits a bottom having converging inclined walls;

said communication holes opening into said converging inclined walls of the cavities;

for each of the cavities there is an obturator conformed in such a way as to occupy substantially all of space therein behind said elastic wall, which obturator is solidly anchored to the elastic wall but is free of the walls of the cavity.

2. The half-die of claim 1, wherein said incompressible fluid contained in the half-die is pressurized to a point above atmospheric pressure by a means for pressurizing.

3. The half-die of claim 1, wherein a zone of each of the cavities occupied by the obturator includes:

the converging inclined walls comprising a conical bottom;

an intermediate zone having a cylindrical shape and having a diameter which is equal to a diameter of a base of said conical bottom and which is coaxial thereto;

an upper zone whose section circumscribes a section of said intermediate zone.

4. The half-die of claim 1, wherein the obturators are made of a semirigid plastic material.

5. The half-die of claim 1, wherein:

the rigid support is made in a single piece;

the chamber exhibits only three external connections, namely: an upper aperture, the inlet hole, and the outlet hole;

in the half-die said three connections are hermetically closed, respectively by the elastic wall, by a first cap and by a second cap; the inlet hole internal mouth and the outlet hole internal mouth each opening on to the bottom of one of the cavities;

the external mouth of the inlet hole and the external mouth of the outlet hole being situated further from said elastic wall than a distance of said elastic wall from any point of said chamber or from said communication holes.

6. The half-die of claim 1, wherein:

the incompressible fluid is at a pressure which is above atmospheric pressure by a means for pressurizing;

in each of said cavities the converging inclined walls comprise a conical bottom, and a zone of each of said cavities includes a cylindrical intermediate zone having a diameter which is equal to a diameter of a base of said conical bottom and being coaxial thereto, and an upper zone whose section circumscribes a section of the intermediate zone;

the rigid support is made in a single piece;

the chamber exhibits externally only three connections, namely an upper aperture, the inlet hole and the outlet hole;

internally of the half-die said connections being hermetically closed, respectively by the elastic wall, by a first cap and by a second cap;

the inlet hole internal mouth and the outlet hole internal mouth each open on to the bottom of one of the cavities;

the inlet hole external mouth and the outlet hole external mouth are both situated further from said elastic wall than a distance of said elastic wall from any point of said chamber or from said communication holes.

* * * * *